US007371951B1

(12) United States Patent
Brunzetti

(10) Patent No.: US 7,371,951 B1
(45) Date of Patent: May 13, 2008

(54) MUSICIAN'S ARTICLE OF CLOTHING WITH STRAP OPENINGS FOR INSERTING AND HOLDING A MUSICAL INSTRUMENT STRAP THEREIN

(76) Inventor: Vernon Brunzetti, 1511 E. 29th Ave., Denver, CO (US) 80205

( * ) Notice: Subject to any disclaimer, the term of this patent is extended or adjusted under 35 U.S.C. 154(b) by 137 days.

(21) Appl. No.: 11/177,318

(22) Filed: Jul. 11, 2005

(51) Int. Cl.
*G10G 5/00* (2006.01)

(52) U.S. Cl. ..... 84/327

(58) Field of Classification Search ..... 84/327, 84/329, 280, 290; 2/113
See application file for complete search history.

(56) References Cited

U.S. PATENT DOCUMENTS

| | | | | | |
|---|---|---|---|---|---|
| 1,444,750 | A * | 2/1923 | Moore | 2/94 |
| 1,849,628 | A * | 3/1932 | Lemercier | 244/143 |
| 2,079,656 | A * | 5/1937 | Mirsky | 450/31 |
| 2,437,988 | A * | 3/1948 | Artzt | 2/80 |
| 2,970,316 | A * | 2/1961 | Silin | 2/94 |
| 3,724,101 | A * | 4/1973 | Slezak | 434/170 |
| 4,079,467 | A * | 3/1978 | Baldwin | 2/94 |
| 4,171,542 | A * | 10/1979 | Cox et al. | 2/51 |
| 4,292,687 | A * | 10/1981 | Daverport, Jr. | 2/462 |
| 4,663,782 | A * | 5/1987 | Knox et al. | 2/104 |
| 4,731,882 | A * | 3/1988 | Ekman | 2/69 |
| 5,301,371 | A * | 4/1994 | Chao | 2/102 |
| 5,437,061 | A * | 8/1995 | Kenner | 2/69 |
| 5,553,323 | A * | 9/1996 | Chou et al. | 2/114 |
| 5,813,051 | A * | 9/1998 | Counter | 2/69 |
| 6,035,440 | A * | 3/2000 | Woodyard | 2/102 |
| 6,119,270 | A * | 9/2000 | Chou | 2/108 |
| 6,212,684 | B1 * | 4/2001 | Waheed | 2/69 |
| 6,421,834 | B2 * | 7/2002 | Kester | 2/94 |
| 2002/0062510 | A1 * | 5/2002 | Mullen | 2/69 |
| 2003/0188370 | A1 * | 10/2003 | Hugh et al. | 2/69 |
| 2004/0163156 | A1 * | 8/2004 | Schweer | 2/69 |
| 2005/0081276 | A1 * | 4/2005 | Reynolds | 2/69 |
| 2005/0278819 | A1 * | 12/2005 | Munn et al. | 2/69 |

* cited by examiner

*Primary Examiner*—Briggitte R. Hammond
(74) *Attorney, Agent, or Firm*—Edwin H. Crabtree; Ramon L. Pizarro

(57) ABSTRACT

A musician's article of clothing for an upper body of a musician and used for receiving a musical instrument strap inside the clothing during a musical performance. The clothing is designed to prevent wear, discoloration and burnoff on the shoulder of the clothing. Also, the strap can be removed from the side of a handheld musical instrument and conveniently stored inside the clothing when the strap and musical instrument are not in use. The front of the shirt includes a shoulder strap opening and a chest strap opening therein. The back of the clothing includes a rear strap opening. When the instrument strap is removed from the musical instrument, the strap is received inside the clothing. A lower end of the strap is extends outwardly through the rear strap opening. The upper end of the strap extends outwardly through the shoulder strap opening or the chest strap opening. The ends of the strap are then attached to the side of the musical instrument prior to the musician's performance.

13 Claims, 2 Drawing Sheets

MUSICIAN'S ARTICLE OF CLOTHING WITH STRAP OPENINGS FOR INSERTING AND HOLDING A MUSICAL INSTRUMENT STRAP THEREIN

BACKGROUND OF THE INVENTION (a) Field of the Invention

This invention relates to an article of clothing used when a musician holds a handheld musical instrument and more particularly, but not by way of limitation, to an upper body article of clothing such as a musician's shirt, vest, jacket, coat and the like having two or more strap openings. The clothing is used for receiving a musical instrument strap therein. The opposite ends of the strap are inserted outwardly through the strap openings and attached to the musical instrument. Also, the clothing can be used for storing the strap when the musical instrument is not being played.

(b) Discussion of Prior Art

Heretofore, musicians playing various types of handheld musical instruments such as a guitar, a keyboard and the like have held the instrument next to their bodies using an instrument strap. The strap is placed over one shoulder of the player with the opposite ends of the strap releasably attached to sides of the guitar. During a performance, the strap moves back and forth on the musician's shirt, coat, jacket and the like causing discoloration and burnoff of the clothing's material. Burnoff is caused by rubbing and heat friction on the clothing material.

The subject invention provides a unique structure, function and advantages when compared to a standard clothing worn by a musician with the instrument strap received over a portion of the shoulder of the clothing.

SUMMARY OF THE INVENTION

In view of the foregoing, it is a primary objective of the subject invention to provide a musician's upper body article of clothing for receiving a musical instrument strap inside the clothing during a musical performance to prevent wear, discoloration and burnoff on the shoulder of the clothing.

Another object of the invention is the strap can be removed from the side of the musical instrument and conveniently stored inside the clothing when the strap and musical instrument are not in use.

Still another object of the unique musician's article of clothing is one end of the strap can be inserted through a shoulder strap opening when the musician holds the instrument upright in a high or near vertical position. Also, the strap can be inserted through a chest strap opening when holding the instrument in a low position or near horizontal position.

The subject invention includes a musician's upper body article of clothing. The clothing is received on the upper body of a musician and used for holding a musical instrument strap therein. The clothing includes a front and a back. The front of the clothing has a shoulder strap opening and a chest strap opening therein. The back of the clothing has a rear strap opening. When the instrument strap is removed from the musical instrument, the strap is received inside the clothing. A lower end of the strap is extended outwardly through the rear strap opening. An upper end of the strap is extended outwardly through the shoulder strap opening or the chest strap opening. The ends of the strap are then attached to the side of the musical instrument prior to the musician's performance.

These and other objects of the present invention will become apparent to those familiar with different types of musician's clothing used by a musician playing a handheld musical instrument with instrument strap attached thereto when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the principles thereof, and in which.

DETAILED DESCRIPTION OF THE PREFERRED EMBODIMENTS

Figure 1:
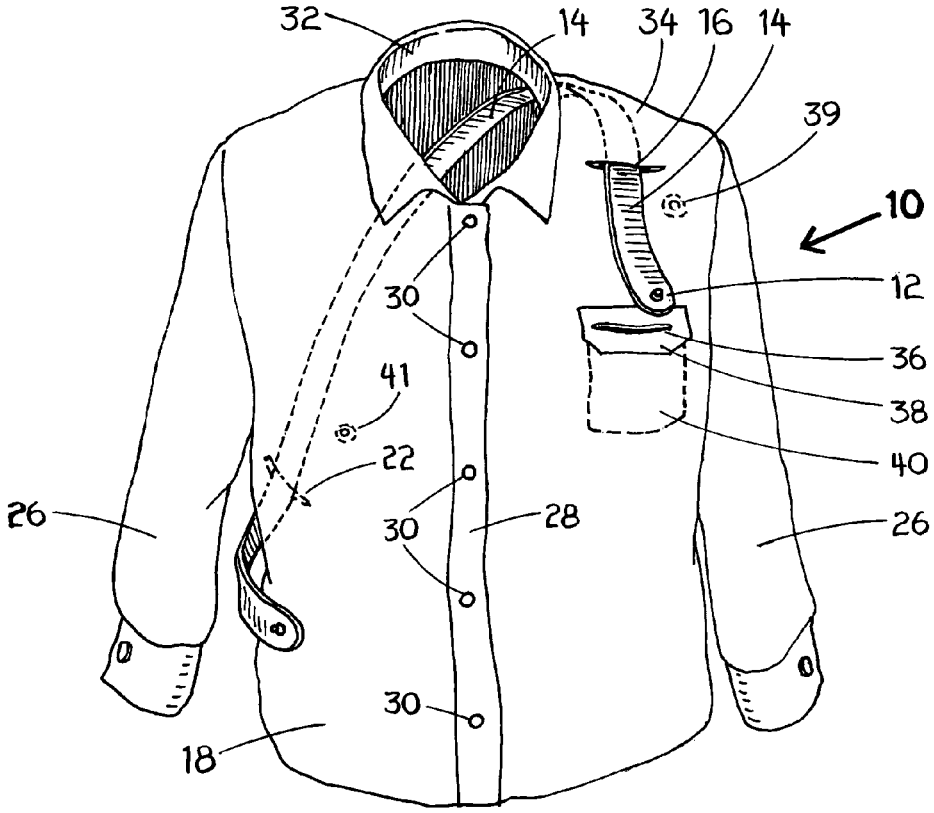
FIG. 1 is a front perspective view of a musician's upper body article of clothing and shown as a musician's shirt and illustrating one end of an instrument strap extending outwardly from a shoulder strap opening and another end of the strap extending outwardly from a rear strap opening.
Figure 2:
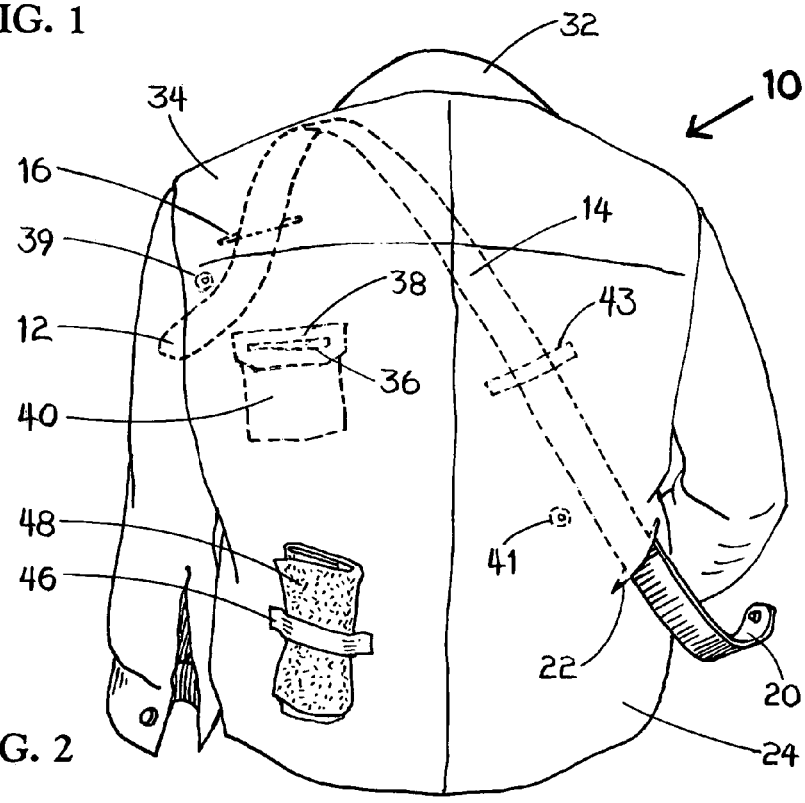
FIG. 2 is a rear perspective of the musician's shirt with the instrument strap received therein.

In FIGS. 1 and 2, a front and a rear perspective view of a musician's upper body article of clothing and shown as a musician's shirt. The shirt is shown having general reference numeral 10. While the shirt 10 is shown in the drawings, it should be kept in mind that the article of clothing can also be a vest, a T-shirt, a coat, a jacket and the like.

The shirt 10 is illustrated with an upper end 12 of an instrument strap 14 extending outwardly from a shoulder strap opening 16 in a front portion 18 of the shirt 10. A lower end 20 of the strap 14 is shown extending outwardly from a rear strap opening 22 in a back portion 24 of the shirt 10. The shirt 10 and similar articles of clothing can come in different sizes, shapes and designs. In this example, the shirt 10 includes long sleeves 26, a front opening 28 with buttons 30 and a collar 32. Obviously, the shirt 10 can be short sleeved and without a collar or front opening.

In these two drawings, the strap 14, shown in dashed lines, is shown received inside the shirt 10. The strap 14 extends along the inside of a shoulder portion 34 of the shirt 10 and across a portion of the inside of the back portion 24 of the shirt 10. The shoulder portion 34 is disposed next to the shoulder strap opening 16.

The shirt 10 also includes a chest strap opening 36 for receiving the end 12 of the strap 14 therethough. As an option, the chest strap opening 36 can be covered with a pocket flap 38 with a pocket 40, shown in dashed lines. Also and if desired, the shoulder strap opening 16 can be covered by a pocket flap with a pocket.

As mentioned above, the shoulder strap opening 16 can be used when the musician holds the instrument upright in a high or near vertical position. Also, the upper end 12 of the strap 14 can be inserted through the chest strap opening 36, when holding the instrument in a low position or near horizontal position.

The shirt 10 further includes an upper anchor button 39 and a lower anchor button 41 attached inside the shirt and next to the shoulder strap opening 16 and the rear strap opening 22. The buttons 39 and 41 are used for attaching to the ends 12 and 20 of the strap 14 thereto and holding the strap in a stored position inside the shirt 10. Also, the shirt 10 can include an internal loop 43 in the back portion 24 for holding the strap 14 in place during storage. It should be mentioned that the strap openings 16 and 22 can have a width in a range of 2 to 4 inches for receiving different widths of instrument straps 14. As an added option, the back portion 24 of the shirt 10 can include an external loop 46 for holding a hand towel 48 and the like.

Figure 3:
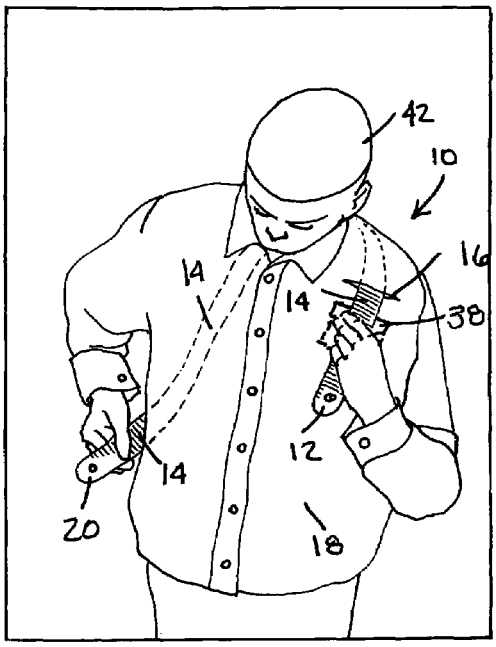
FIG. 3 is a front perspective view of a musician adjusting the instrument strap inside the shirt and in preparation of attaching the ends of the strap to a musical instrument.

In FIG. 3, a front perspective view of a musician 42 is shown wearing the subject musician's shirt 10. In this drawing, the musician 42 is adjusting the instrument strap 14 inside the shirt 10 and in preparation of attaching the ends 12 and 20 of the strap 14 to a musical instrument 44. In this example, the musician 42 has inserted the upper end 12 through the shoulder strap opening 16 rather than the lower chest strap opening 36.

Figure 4:
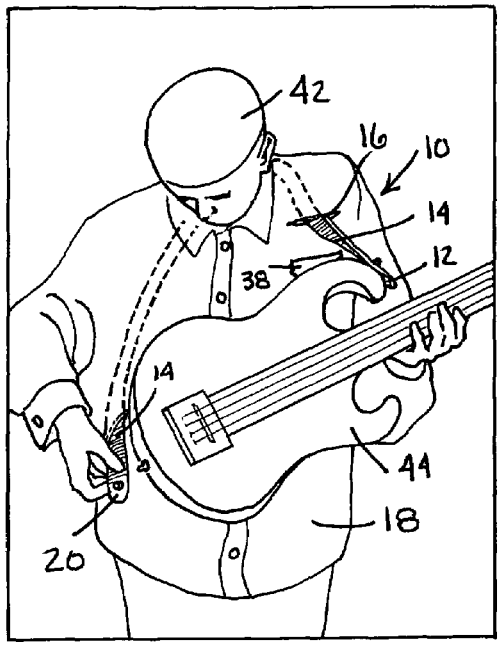
FIG. 4 is a front perspective view of the musician shown attaching one of the strap to the side of the musical instrument.

In FIG. 4, a front perspective view of the musician 42 is shown attaching the lower end 20 of the strap 14 to a side of the musical instrument 44.

Figure 5:
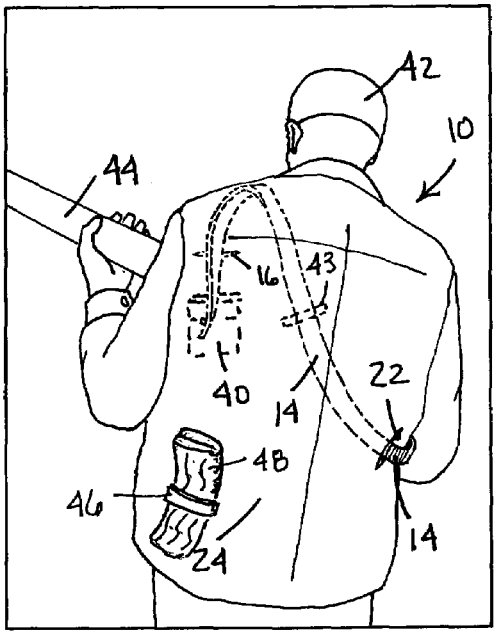
FIG. 5 is a rear perspective view of the musician using the subject musician's shirt with the strap received inside the shirt and the strap ends attached to the musical instrument.

In FIG. 5, a rear perspective view of the musician 42 is shown using the subject musician's shirt 10 with the strap 14 received therein. The strap ends 12 and 20 are attached to the musical instrument 44.

Figure 6:
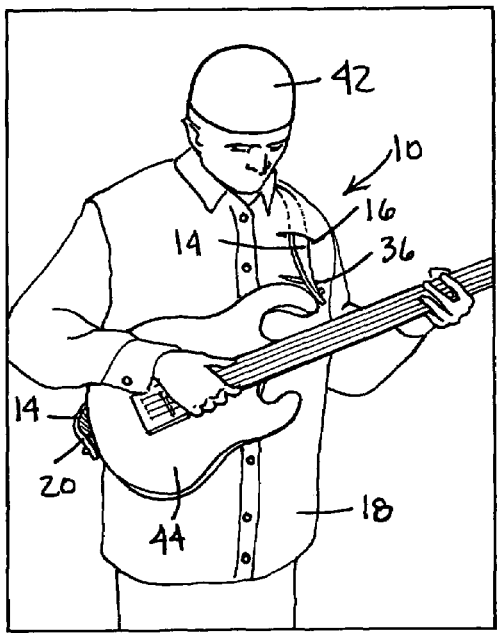
FIG. 6 is another front view of the musician and shown using the subject invention and playing the musical instrument.

In FIG. 6, another front view of the musician 42 is illustrated using the musician's shirt 10. In this drawing, the musician 42 is shown playing the musical instrument 42. When the musician 42 has completed his performance, the strap ends 12 and 20 can be removed from the side of the musical instrument 44. At this time, the musician can change out of the shirt 10 and the strap ends 12 and 20 attached to the anchor buttons 39 and 41 for storing the strap 14 therein until the shirt is used again.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A shirt worn over an upper body of a musician, the shirt used for receiving a musical instrument strap inside the shirt during a musical performance, opposite ends of the strap are releasably attached to sides of a handheld musical instrument, a length of the strap inside the shirt extends over the top of a first shoulder of the musician, the strap inside the shirt and next to a back of the musician angles downwardly from the first shoulder to below a second shoulder of the musician, the shirt comprising:

a front portion, said front portion having a horizontal shoulder strap opening next to the first shoulder of the musician, said horizontal shoulder strap opening adapted for receiving an upper end of the instrument strap therethrough and outwardly for attachment to the instrument; said horizontal shoulder strap opening perpendicular to the length of the strap, said horizontal shoulder strap opening having a width in a range of 2 to 4 inches in length;

a horizontal chest strap opening in said front portion, said horizontal chest strap opening disposed below said horizontal shoulder strap opening, said horizontal chest strap opening perpendicular to the length of the strap, said horizontal chest strap opening adapted for receiving the upper end of the instrument strap therethrough and outwardly for attachment to the instrument, said horizontal shoulder strap opening having a width in a range of 2 to 4 inches;

a pocket flap and pocket disposed in said front portion, said pocket flap covering said horizontal chest strap opening in said front portion;

an upper anchor button attached to an inside of said front portion, said upper anchor button disposed next to said horizontal shoulder strap opening, said upper anchor button adapted for attachment to the upper end of the instrument strap;

a back portion, said back portion having an angled rear strap opening below the second shoulder of the musician, said angled rear strap opening adapted for receiving a lower end of the instrument strap therethrough and outwardly for attachment to the instrument, said angled rear strap opening perpendicular to the length of the strap, said angled rear strap opening having a width in a range of 2 to 4 inches;

a lower anchor button attached to an inside of said back portion, said lower anchor button disposed next to said angled rear strap opening, said lower anchor button adapted for attachment to the lower end of the instrument strap; and an internal loop attached to said back portion, said internal loop adapted for receiving a portion of the instrument strap therethrough.

2. A shirt worn over an upper body of a musician, the shirt used for receiving a musical instrument strap inside the shirt during a musical performance, opposite ends of the strap are releasably attached to sides of a handheld musical instrument, a length of the strap inside the shirt extends over the top of a first shoulder of the musician, the strap inside the shirt and next to a back of the musician angles downwardly from the first shoulder to below a second shoulder of the musician, the shirt comprising:

a front portion, said front portion having a horizontal shoulder strap opening next to the first shoulder of the musician, said horizontal shoulder strap opening adapted for receiving an upper end of the instrument strap therethrough and outwardly for attachment to the instrument; said horizontal shoulder strap opening perpendicular to the length of the strap;

a back portion, said back portion having an angled rear strap opening below the second shoulder of the musician, said angled rear strap opening adapted for receiving a lower end of the instrument strap therethrough and outwardly for attachment to the instrument, said angled rear strap opening perpendicular to the length of the strap; and an upper anchor button attached to an inside of said front portion, said upper anchor button disposed next to said horizontal shoulder strap opening, said upper anchor button adapted for attachment to the upper end of the instrument strap.

3. The shirt as described in claim 2 further including an lower anchor button attached to an inside of said back portion, said lower anchor button disposed next to said angled rear strap opening, said lower anchor button adapted for attachment to the lower end of the instrument strap.

4. The shirt as described in claim 2 further including an external loop attached to said back portion, said external loop adapted for receiving a hand towel.

5. The shirt as described in claim 2 further including an internal loop attached to said back portion, said internal loop adapted for receiving a portion of the instrument strap therethrough.

6. The shirt as described in claim 2 further including a horizontal chest strap opening in said front portion, said horizontal chest strap opening disposed below said horizontal shoulder strap opening, said horizontal chest strap opening perpendicular to the length of the strap, said horizontal chest strap opening adapted for receiving the upper end of the instrument strap therethrough and outwardly for attachment to the instrument.

7. The shirt as described in claim 6 further including a pocket flap and pocket disposed in said front portion, said pocket flap covering said horizontal chest strap opening in said front portion.

8. The shirt as described in claim 6 wherein said horizontal shoulder strap opening, said horizontal chest strap opening and said angled rear strap opening have a width in a range of 2 to 4 inches.

9. A shirt worn over an upper body of a musician, the shirt used for receiving a musical instrument strap inside the shirt during a musical performance, opposite ends of the strap are releasably attached to sides of a handheld musical instrument, a length of the strap inside the shirt extends over the top of a first shoulder of the musician, the strap inside the shirt and next to a back of the musician angles downwardly from the first shoulder to below a second shoulder of the musician, the shirt comprising:

a front portion, said front portion having a horizontal shoulder strap opening next to the first shoulder of the musician, said horizontal shoulder strap opening adapted for receiving an upper end of the instrument strap therethrough and outwardly for attachment to the instrument; said horizontal shoulder strap opening perpendicular to the length of the strap, said horizontal shoulder strap opening having a width in a range of 2 to 4 inches in length;

a horizontal chest strap opening in said front portion, said horizontal chest strap opening disposed below said horizontal shoulder strap opening, said horizontal chest strap opening perpendicular to the length of the strap, said horizontal chest strap opening adapted for receiving the upper end of the instrument strap therethrough and outwardly for attachment to the instrument, said horizontal shoulder strap opening having a width in a range of 2 to 4 inches;

a back portion, said back portion having an angled rear strap opening below the second shoulder of the musician, said angled rear strap opening adapted for receiving a lower end of the instrument strap therethrough and outwardly for attachment to the instrument, said angled rear strap opening perpendicular to the length of the strap, said angled rear strap opening having a width in a range of 2 to 4 inches; and a pocket flap and pocket disposed in said front portion, said pocket flap covering said horizontal chest strap opening in said front portion.

10. The shirt as described in claim 9 further including an upper anchor button attached to an inside of said front portion, said upper anchor button disposed next to said horizontal shoulder strap opening, said upper anchor button adapted for attachment to the upper end of the instrument strap.

11. The shirt as described in claim 9 further including an lower anchor button attached to an inside of said back portion, said lower anchor button disposed next to said angled rear strap opening, said lower anchor button adapted for attachment to the lower end of the instrument strap.

12. The shirt as described in claim 9 further including an external loop attached to said back portion, said external loop adapted for receiving a hand towel.

13. The clothing as described in claim 9 further including an internal loop attached to said back portion, said internal loop adapted for receiving a portion of the instrument strap therethrough.

* * * * *